US007730699B2

(12) United States Patent
Asma

(10) Patent No.: US 7,730,699 B2
(45) Date of Patent: Jun. 8, 2010

(54) PACKAGING MACHINE FOR LOLLIPOPS AND OTHER CONFECTIONERY

(75) Inventor: Seferinus Jelle Asma, CM Veldhoven (NL)

(73) Assignee: CFS Weert B.V. (NL)

( * ) Notice: Subject to any disclaimer, the term of this patent is extended or adjusted under 35 U.S.C. 154(b) by 0 days.

(21) Appl. No.: 11/911,295

(22) PCT Filed: Apr. 4, 2006

(86) PCT No.: PCT/EP2006/061315

§ 371 (c)(1),
(2), (4) Date: Apr. 17, 2008

(87) PCT Pub. No.: WO2006/108782

PCT Pub. Date: Oct. 19, 2006

(65) Prior Publication Data

US 2009/0019820 A1 Jan. 22, 2009

(30) Foreign Application Priority Data

Apr. 14, 2005 (NL) ..... 1028768

(51) Int. Cl.
*B65B 11/00* (2006.01)

(52) U.S. Cl. ..... 53/594; 53/234; 53/370

(58) Field of Classification Search ..... 53/466, 53/228, 232, 234, 370, 594
See application file for complete search history.

(56) References Cited

U.S. PATENT DOCUMENTS

| | | | | |
|---|---|---|---|---|
| 1,809,358 | A | 6/1931 | Savage | |
| 2,246,243 | A | 6/1941 | Ross | |
| 2,705,857 | A | 4/1955 | Fox et al. | |
| 2,872,768 | A * | 2/1959 | Shepler | 53/594 |
| 3,038,635 | A | 6/1962 | Rasmussen | |
| 3,264,115 | A | 8/1966 | Davis | |
| 3,741,698 | A | 6/1973 | Caroli | |
| 3,851,440 | A | 12/1974 | Horsky | |
| 3,987,605 | A | 10/1976 | Johnson | |
| 4,008,812 | A | 2/1977 | Stuart | |
| 4,130,936 | A | 12/1978 | Cottrell | |

(Continued)

FOREIGN PATENT DOCUMENTS

DE 4213830 A1 11/1993

(Continued)

OTHER PUBLICATIONS

Copending application, U.S. Appl. No. 12/301,111, filed Nov. 17, 2008, ( also published as WO2007/134708).

(Continued)

*Primary Examiner*—Louis K Huynh
(74) *Attorney, Agent, or Firm*—Dobrusin & Thennisch PC

(57) ABSTRACT

Packaging machine for packaging lollipops provided with a stick and a head in a film/foil sheet, comprising a rotatably driven drum having a series of lollipop holders thereon, the drum furthermore being provided with a series of film/foil folding means for folding a respective film/foil sheet around the head around a longitudinal center axis substantially parallel to the stick, the device furthermore comprising a series of twisters for twisting a film/foil tube section protruding in the longitudinal direction of the lollipop head while continuing to clamp the lollipop head and while the drum continues to rotate.

6 Claims, 16 Drawing Sheets

U.S. PATENT DOCUMENTS

| | | | | |
|---|---|---|---|---|
| 4,459,792 | A * | 7/1984 | Derckx | 53/370 |
| 4,535,605 | A | 8/1985 | Gram | |
| 4,539,790 | A | 9/1985 | Zamboni | |
| 4,714,419 | A | 12/1987 | Nielsen | |
| 4,729,501 | A | 3/1988 | Lowrance | |
| 5,016,421 | A | 5/1991 | Ferrero | |
| 5,108,279 | A | 4/1992 | Heckler et al. | |
| 5,117,613 | A | 6/1992 | Pfaffmann | |
| 5,241,807 | A | 9/1993 | Quick et al. | |
| 5,450,706 | A | 9/1995 | Latini | |
| 5,519,981 | A | 5/1996 | Fukusaki | |
| 5,826,403 | A | 10/1998 | Haley | |
| 6,077,144 | A * | 6/2000 | Fishman | 446/236 |
| 6,402,496 | B2 | 6/2002 | Ishikawa et al. | |
| 6,633,480 | B1 | 10/2003 | Herzog | |
| 7,210,916 | B2 | 5/2007 | Korndorfer et al. | |
| 7,287,361 | B2 * | 10/2007 | Asma | 53/594 |
| 7,344,742 | B2 | 3/2008 | Wray et al. | |
| 2007/0272089 | A1 | 11/2007 | Asma | |
| 2009/0019820 | A1 | 1/2009 | Asma et al. | |
| 2009/0056287 | A1 * | 3/2009 | Cuypers | 53/594 |

FOREIGN PATENT DOCUMENTS

| | | | |
|---|---|---|---|
| DE | 19502562 | | 8/1996 |
| DE | 19616989 | | 10/1997 |
| DE | 10319829 | | 11/2004 |
| EP | 0036282 | A1 | 9/1981 |
| EP | 0073535 | A2 | 3/1983 |
| EP | 0616942 | | 9/1994 |
| EP | 0950608 | | 4/1998 |
| EP | 09050608 | | 4/1998 |
| EP | 1041005 | | 10/1998 |
| EP | 0742152 | B1 | 8/1999 |
| EP | 0737619 | B1 | 11/1999 |
| EP | 0956776 | | 11/1999 |
| EP | 0842854 | B1 | 3/2001 |
| EP | 1357063 | | 3/2005 |
| GB | 328145 | | 4/1930 |
| GB | 374653 | | 6/1932 |
| GB | 406220 | | 2/1934 |
| GB | 998643 | | 12/1970 |
| GB | 1214983 | | 12/1970 |
| GB | 2219725 | | 12/1989 |
| GB | 2229347 | | 9/1990 |
| GB | 2312411 | A | 10/1997 |
| JP | 9039919 | | 2/1997 |
| NL | 1028769 | C2 | 10/2006 |
| WO | 00/21835 | A1 | 4/2000 |
| WO | 0041573 | | 7/2000 |
| WO | 03/086871 | | 10/2003 |
| WO | 2004/066747 | | 8/2004 |
| WO | 2004/113172 | | 12/2004 |
| WO | 2005/041679 | | 5/2005 |
| WO | 2006/108781 | | 10/2006 |
| WO | 2006/108782 | | 10/2006 |
| WO | 2006/136394 | | 12/2006 |
| WO | 2007/134708 | A2 | 12/2006 |
| WO | 2007/121930 | | 11/2007 |

OTHER PUBLICATIONS

Copending application, U.S. Appl. No. 10/578,812, filed Mar. 8, 2007, published as 2007/0272089.

International Search Report PCT/EP2006/061314 Jun. 20, 2006 (Published as WO2006/108781).

International Search Report WO2006/136394 Dec. 28, 2006.

International Search Report, WO2006/108782, published Oct. 19, 2006.

Preliminary Report on Patentability, PCT/EP2006/005965, date Oct. 5, 2007.

Preliminary Report on Patentability, PCT/EP2006/061314, date Oct. 16, 2007.

Preliminary Report on Patentability, PCT/EP2006/005965, date Dec. 21, 2007.

International Search Report PCT/EP2007/003455, published Nov. 1, 2007, published as WO2007/121930A1.

International Preliminary Report on Patentability, Dated Jul. 28, 2008, Application No. PCT/EP2007/003455.

Copending application, U.S. Appl. No. 11/911,293, filed Oct. 11, 2007, (WO2006/108781).

Copending application, U.S. Appl. No. 11/933,129, filed Dec. 19, 2007, (WO2006/136394).

Copending application, U.S. Appl. No. 12/297,362, filed Oct. 16, 2008, (WO2007/121930).

* cited by examiner

PACKAGING MACHINE FOR LOLLIPOPS AND OTHER CONFECTIONERY

CLAIM OF BENEFIT OF FILING DATE

The present application claims the benefit of the filing date of PCT Application Serial No. PCT/EP2006/061315, (filed Apr. 4, 2006) (Published as WO 2006/108782); NL 1028768 (filed Apr. 14, 2005), the contents of which are hereby incorporated by reference in their entirety.

TECHNICAL FIELD

The invention relates to a packaging machine for lollipops and optionally other confectionery.

BACKGROUND OF INVENTION

It is known to package lollipops in a film/foil sheet, in which case the lollipops and the film/foil sheets are fed to a drum in which the lollipops are packaged. The lollipops and the associated film/foil sheet are received between two clamping jaws which co-rotate with the drum to a twisting station. During this displacement, the film/foil sheet is closed in on itself with the aid of a guide or rail arranged in a fixed position. At the location of the twisting station, the lollipop is held stationary and two twisters, each having two twister arms provided with film/foil clamps, are brought into clamping engagement with the film/foil tube sections projecting from the lollipop head, following which the twisters are rotated, thus twisting the film/foil tube sections. A seal can be brought about by means of hot blown air at the location of the two twisted ends of the film/foil sheet. Following the twisting, the drum runs on and passes the packaged lollipop on to a discharge. The clamping jaws are then able to pick up another lollipop.

Although good packaging results are achieved with the known machine, also referred to as Twistwrapper 300 by Aquarius/CFS, there is a need for an improved machine, in particular with regard to speed. Much time is lost due to the machine stopping and starting up again for each lollipop. In addition, repeated stopping and starting up of the drum puts the construction under a lot of strain, which may result in failures.

SUMMARY OF THE INVENTION

It is an object of the invention to provide a packaging machine for lollipops which is able to achieve a high frequency.

It is an object of the invention to provide a packaging machine for lollipops and/or optionally other confectionery having a reliable and high output.

According to one aspect, the invention provides a packaging machine for packaging lollipops provided with a stick and a head in a film/foil sheet, comprising a rotatably driven drum having a series of lollipop holders thereon, the drum furthermore being provided with a series of film/foil folding means for folding a respective film/foil sheet around the head around a longitudinal centre axis substantially parallel to the stick, the device furthermore comprising a series of twisters for twisting a film/foil tube section protruding in the longitudinal direction of the lollipop head while continuing to clamp the lollipop head and while the drum continues to rotate.

Thus, the twisting is carried out while the drum continues to revolve, so that the displacement time is used for twisting and the drum does not have to be stopped and started up again.

Preferably, the twisters comprise first and second twisting means which twist the film/foil tube sections protruding on either side of the head, viewed in the longitudinal direction.

In a structurally advantageous embodiment, the lollipop holders are arranged on a first disc and the twisters are arranged on at least one second disc, the first and second discs being connected to one another for concomitant rotation. Each disc thus bears its own series of tools (twisters, lollipop holders), which tools can thus be replaced/exchanged by series. There may also be sufficient space for the operating means for the different kinds of tools.

In a simple embodiment, the first disc is driven directly and the second disc is entrained by the first disc in the rotating movement. The first disc may for example be attached to a drive shaft and the second disc may be attached to the first disc by means of pins. The second disc may then be free from the shaft.

In the case of first and second twisters, the first twisters may be arranged on the second disc and the second twisters may be arranged on a further second disc, both second discs being situated on either side of the first disc. The forces exerted on both second discs will be approximately equal, as a result of which the first disc will also be loaded substantially symmetrically.

In a further embodiment, means are present for adjusting the position of a group of twisters relative to the lollipop holders, viewed in a direction parallel to the rotary shaft. In this way, they can be adapted to the length of the lollipop head of the lollipops to be packaged.

The film/foil folding means can be provided with folding parts for turning the packaging sheet over from a receiving state, in which it is folded around the lollipop head substantially in a V-shape or U-shape, to a substantially tubular subsequent state in which the initially protruding legs of the packaging sheet are made to overlap.

The folding parts may be designed to form an overlap where the inside of one film/foil sheet leg extends over the outside of the other film/foil sheet leg. The folding parts may comprise a first and a second folding arm, which are provided with folding ends which are oppositely tapered in order to overlap at least at the location thereof, thus facilitating the folding process.

The folding parts may be provided with operating means for the folding arms, which are designed to first activate the trailing folding arm and then the leading folding arm in order to assist the folding process. The operating means of the folding arms may furthermore be designed to deactivate the trailing folding arm once the leading folding arm has been activated.

Furthermore, means may be present in a manner known per se for supplying heat to the protruding tube sections.

It is known to pick up sweets from a supply, for example a distribution disc which is provided on the edge with holding spaces for the sweets, and to transfer these to a downstream processing station, such as a downstream process wheel, to which end use can be made of a take-over wheel. The take-over wheel is provided with a series of clamp pairs between which the sweet is clamped and thus removed from the distribution disc. In order to facilitate removal, the clamp pairs can be accelerated/decelerated relative to the rotational movement of the take-over wheel in order to increase the time available for the pick-up without limiting the speed of rotation of the take-over wheel. In a known embodiment, the clamping arms are rotatably attached to a carrier which is itself rotatably attached to the take-over wheel. The rotation of the clamp pairs takes place by rotating the carrier with the clamp pair.

It is an object of the invention to provide a take-over wheel with clamp pairs, in particular rotatable clamp pairs which can be operated in a simple manner and/or are of simple design.

According to another aspect, the invention provides a packaging machine for separated confectionery, comprising a feeder for supplying the separated confectionery and a driven take-over wheel rotating about a first rotary shaft for taking the confectionery from the feeder and delivering it to a processing station situated downstream thereof in the processing direction, such as a station for supplying packaging for the confectionery, the take-over wheel being provided with a series of take-over units extending in the direction of rotation, each of which comprises a first and second clamping arm, which are both provided with clamping jaws for clamping the confectionery, the first and second clamping arms being rotatable relative to one another between a clamping the position and an open position, the first clamping arm being arranged on the second clamping arm so as to be able to rotate.

In this case, the first clamping arm can be short, thus leading to a saving in mass.

Preferably, the second clamping arm is arranged on the take-over wheel so as to be able to rotate about a second rotary shaft, the first and the second rotary shafts being parallel. In order to accelerate/decelerate the clamping arms, it is sufficient to accelerate/decelerate the mass of the two clamping arms. In this case, the support is formed by the second clamping arm, as a result of which the design is simple.

In one embodiment, the first clamping arm is arranged on the second clamping arm so as to be able to rotate about a third rotary shaft, the first, second and third rotary shafts being parallel to one another.

In one embodiment, the take-over wheel is provided with first operating means and the second clamping arm is provided with second operating means cooperating with the former in order to successively accelerate and decelerate the take-over unit in the direction of rotation about the second shaft during a uniform rotary movement of the take-over wheel. The take-over wheel may be provided with third operating means and the first clamping arm with fourth operating means cooperating with the former in order to rotate the first clamping arms about the third rotary shaft between an open position and the clamping position.

The first clamping arm may be L-shaped, the third rotary shaft being situated in the angular range of the L-shaped first clamping arm.

Preferably, the first and second clamping arms are made from metal.

In one embodiment, the take-over wheel and its take-over units are designed for transferring lollipops provided with sticks. The take-over process is facilitated if the first and second clamping arms are designed to clamp the stick of the lollipops, so that they can be active outside the edge of the distribution disc, should the latter be used.

Before they can be packaged, the lollipops have to be combined with a film/foil sheet, one for each lollipop. It is important that this combining process does not limit the speed of the other processes. Furthermore, it is important that the lollipops and film/foil sheets are presented to the downstream process in an efficient manner.

According to a further aspect, the invention provides a packaging machine for packaging separated lollipops, comprising a feeder for supplying the separated confectionery and a transfer wheel rotationally driven about a rotary shaft for taking the lollipops from the feeder and delivering them to a further station arranged downstream thereof viewed in the processing direction, a supply for packaging material being disposed near the transfer wheel, which supply is provided with means for supplying a web of packaging material, with means for successively cutting the web of packaging material into sheets, and with means for successively delivering the sheets to the transfer wheel, the transfer wheel being provided with a series of take-over units extending in the direction of rotation, each of which comprises a first and a second clamping arm, both of which are provided with clamping jaws for clamping the lollipops on opposite sides of the head thereof, the first and second clamping arms being rotatable relative to one another between a clamping position and an open position, the clamping arms being rotatable about rotary shafts which have a tangential directional component relative to the transfer wheel. Thus, the lollipop can be clamped axially, as a result of which the take-over and supply of radially clamped lollipop holders is facilitated. Moreover, in this case the space radially lateral of the lollipop head can be kept clear for supplying and clamping the film/foil.

Preferably, the rotary shafts of the clamping arms are directed tangentially relative to the transfer wheel.

Clamping the lollipop head on the side of the stick is assisted if one of the clamping jaws is provided with a passage for the stick.

Preferably, the passage widens radially outwards, so that the stick does not impede the placement and removal of the clamping jaw to be arranged on the side of the stick.

Preferably, the contour of the clamping jaws has been chosen such that it does not remain within the contour of the lollipop head, so that the film/foil sheet can be clamped against the clamping jaws and the clamping force can be high.

The transfer wheel may be provided with means for clamping a packaging sheet on at least one of the clamping arms, preferably by spring force. The sheet clamping means may be designed for clamping the packaging sheet on both clamping arms, so that the sheet is held firmly and safely.

In order not to subject the lollipop head to clamping forces, the sheet clamping means may be designed to remain at a distance from the lollipop head when clamping the packaging sheet.

The supply for packaging material may be arranged such that it delivers the sheets in a plane transverse to the rotary shaft of the transfer wheel.

In one embodiment, the transfer wheel is provided with first operating means and each pair of clamping arms is provided with second operating means cooperating with the former for moving the clamping arms between the open position and the clamping position. The first operating means may comprise a cam track and the second operating means may comprise a convex cam roller which can be moved by the cam track and is attached to one of the clamping arms. The clamping arms are preferably connected to one another for concomitant yet opposite movement.

According to a further aspect, the invention provides a packaging machine for lollipops, in which the lollipop head is packaged in a packaging sheet according to the double-twist process, comprising a packaging wheel rotating about a rotary shaft, a series of packaging units extending in the direction of rotation, each of which comprises a first and a second clamping arm, both of which are provided with clamping jaws for clamping the lollipops on opposite sides of its head, transverse to the direction of the stick, with the packaging sheet in between, the packaging units furthermore being provided with folding means for turning the packaging sheet over from a receiving state, in which it is folded around the lollipop head substantially in a V-shape or U-shape, to a substantially tubular subsequent state in which the initially protruding legs of the packaging sheet are made to overlap, the packaging units furthermore being provided with first and second grippers for clamping and twisting the tube sections protruding from the lollipop head.

According to a further aspect, the invention provides a packaging machine for lollipops, comprising a take-over wheel according to the invention, a transfer wheel according to the invention, and a twist packaging wheel according to the invention, the transfer wheel adjoining the take-over wheel in the processing direction and the packaging wheel adjoining the transfer wheel in the processing direction.

Preferably, the supply and the discharge of the lollipops to be packaged are directed in opposite directions and take place at a rear side of the machine.

The aspects and measures described and/or shown in the application may, if possible, also be employed separately from one another. These separate aspects, such as the various stick clamps in the separate wheels and other aspects may be the subject of split patent applications specifically aimed at that.

BRIEF DESCRIPTION OF THE DRAWINGS

The invention will be explained with reference to an exemplary embodiment illustrated in the appended drawings, in which.

DETAILED DESCRIPTION OF THE INVENTION

Figure 1:
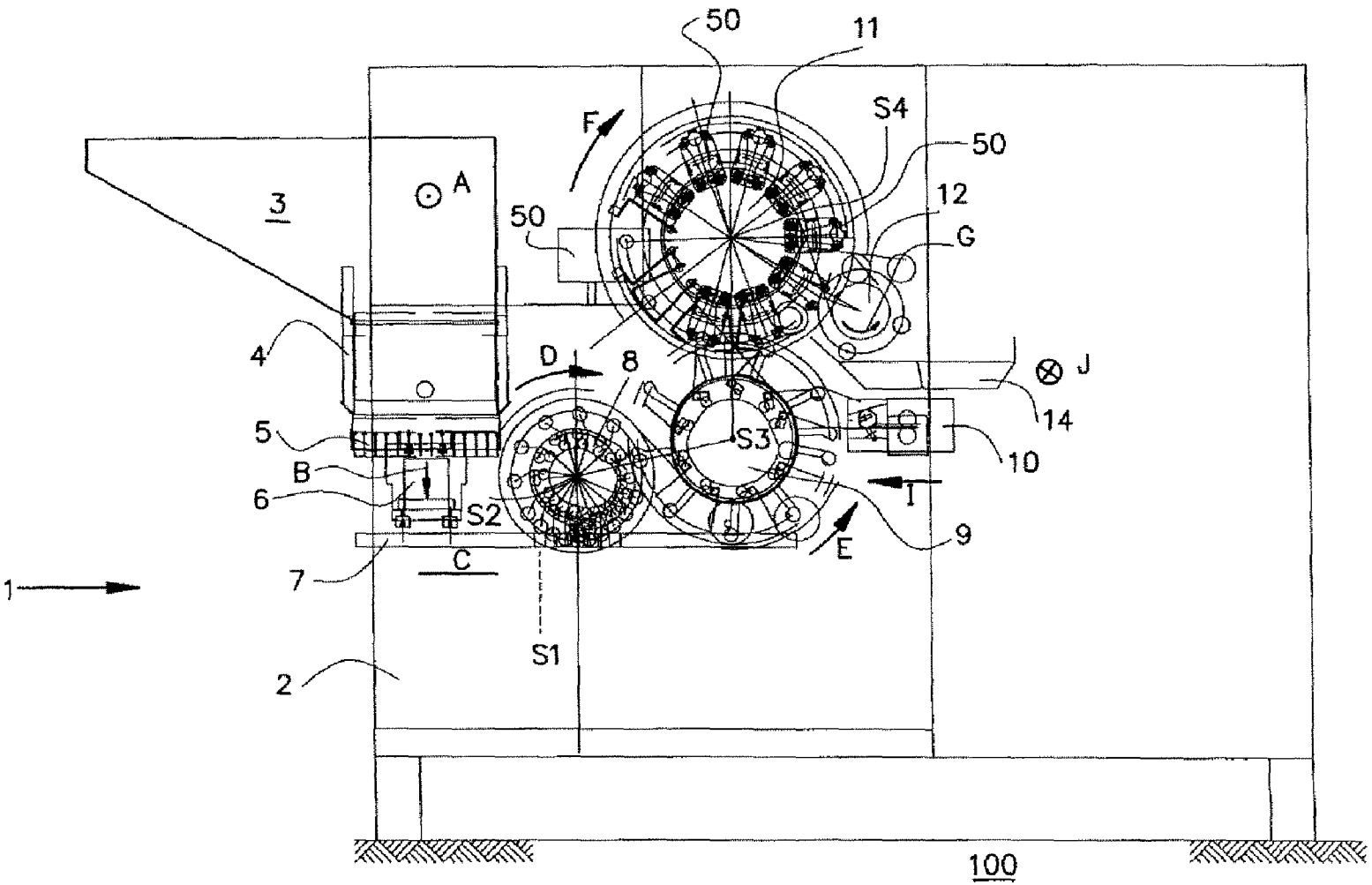
FIG. 1 shows a diagrammatic front view of an exemplary embodiment of a device according to the invention.
Figure 2:
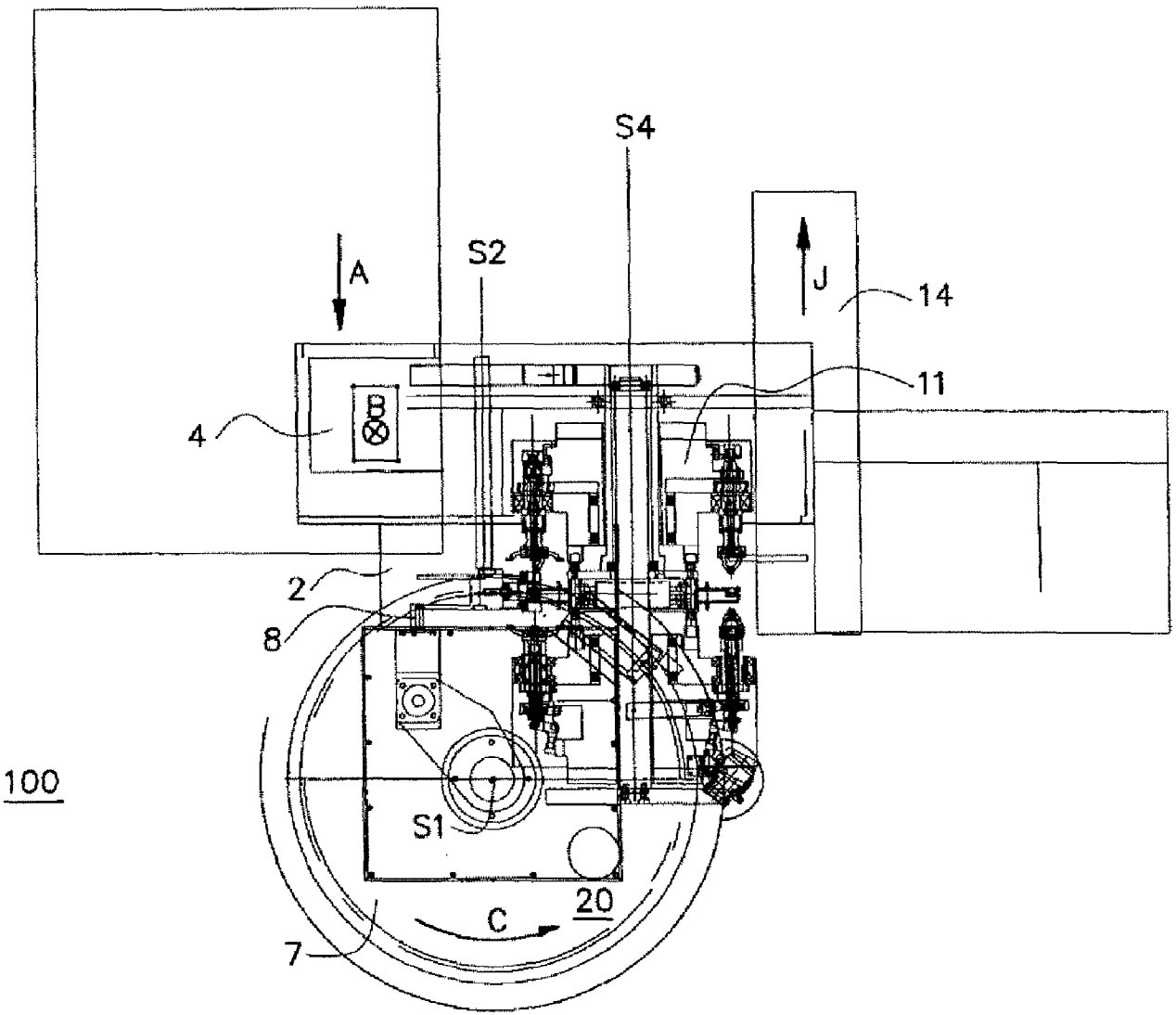
FIG. 2 shows a diagrammatic top view of the device from FIG. 1.
Figure 3:
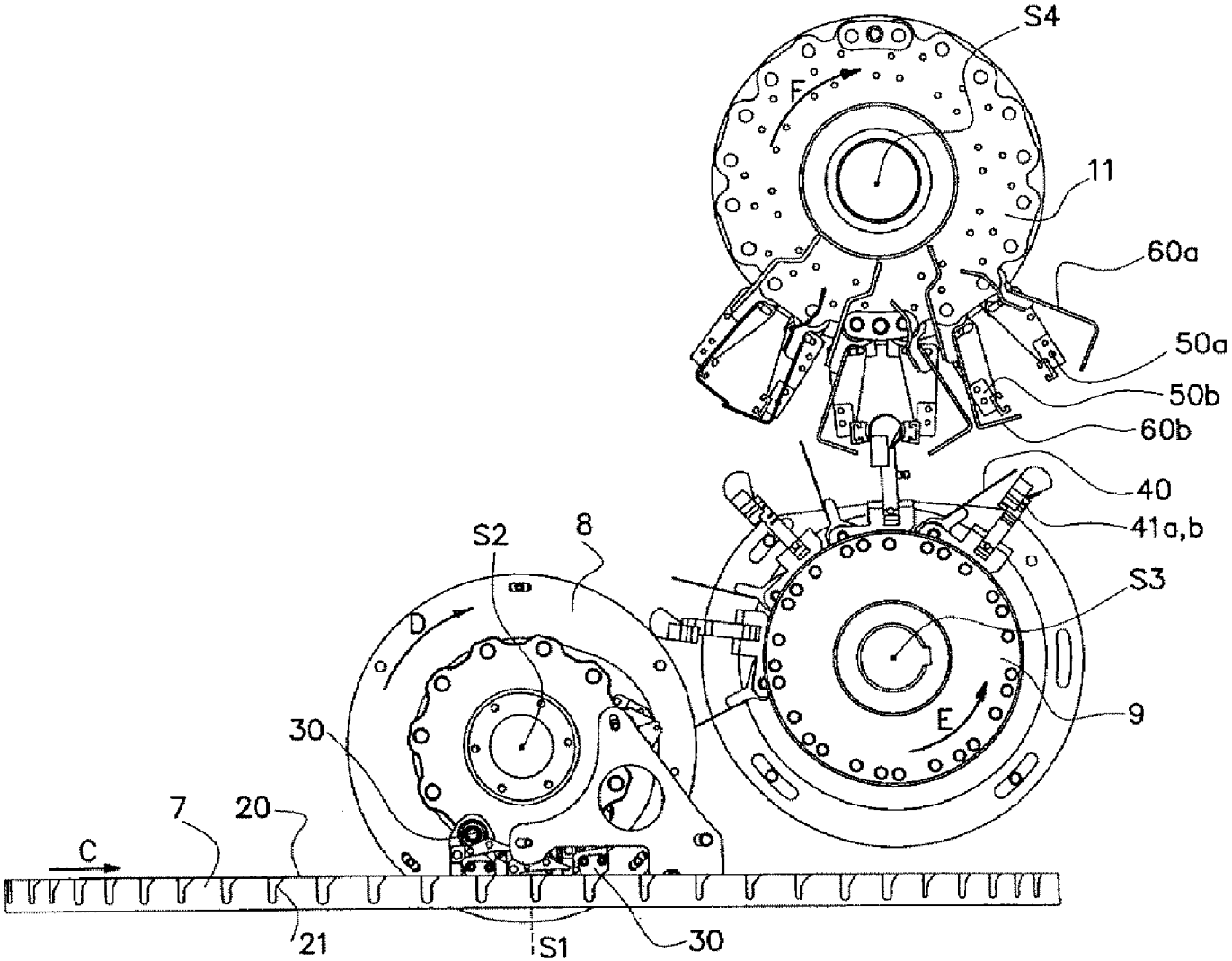
FIG. 3 shows a diagrammatic illustration of a number of process wheels placed in line in the device from FIGS. 1 and 2.
Figure 5:
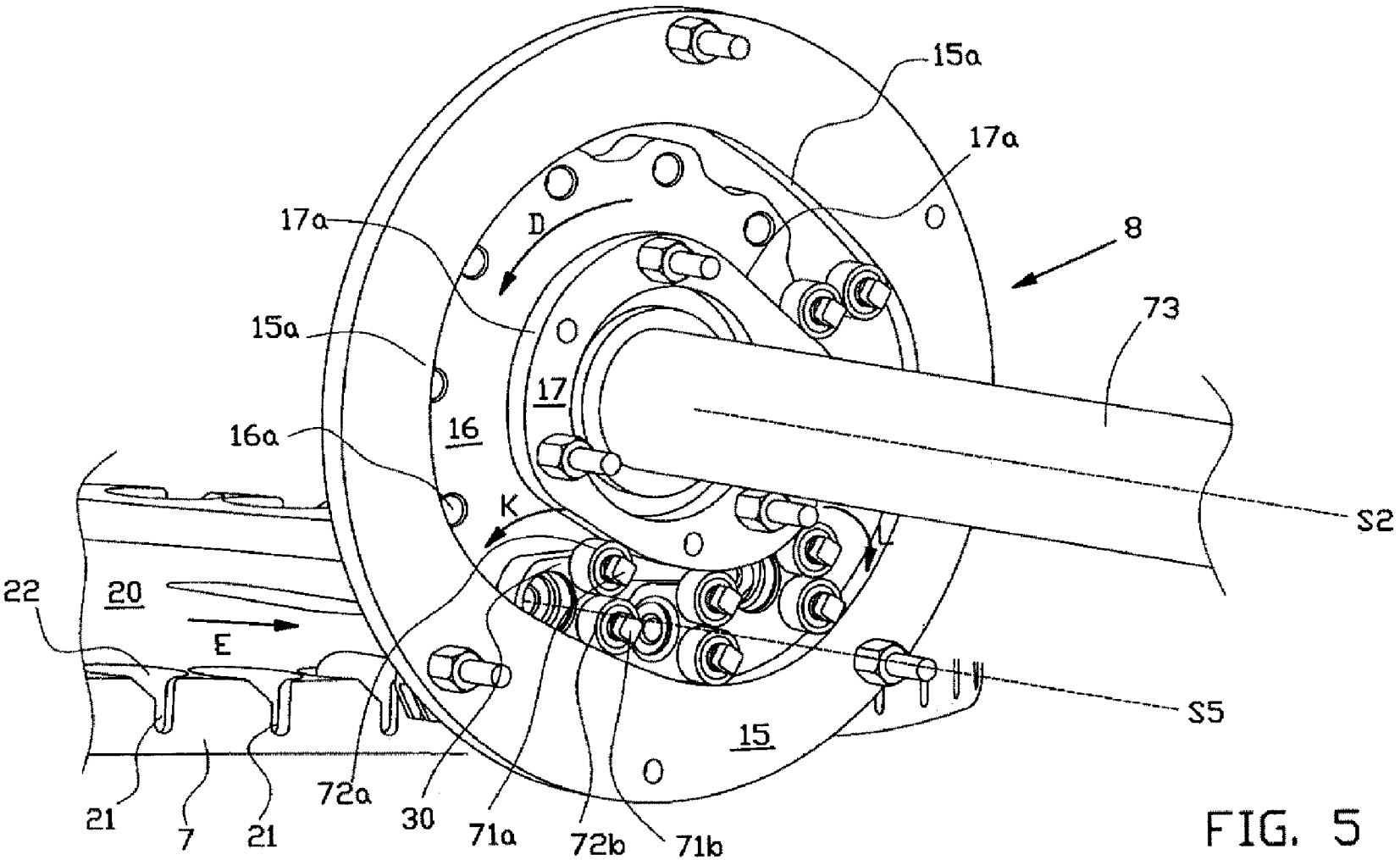
FIG. 5 shows an angled rear view of a section of the second process wheel from FIG. 4.

The exemplary packaging device 1 in FIG. 1 et seq. comprises a frame 2 which is placed on a base 100. The device 1 comprises a supply container 3 for lollipops provided with a stick and a head, supplied in bulk in the direction A. At its bottom end, the container changes into a passage which has a shaking slope 5/6 on its bottom side which passes the lollipops in a stream in the direction B to a distribution disc 7 rotatable in the direction C along a vertical centre line S1. As can be seen in FIG. 2, the distribution disc 7 has a relatively large distribution surface 20, on which the lollipops supplied in bulk can be spread out. As can be seen in FIGS. 2, 3 and 5, the distribution disc 7 is provided on the edge with holding spaces 22 for the head of the lollipop and with radially outwardly extending slots 21 for the sticks thereof. The lollipops with lollipop sticks are brought into an orientation with the sticks directed radially outwardly and then retained with the aid of means (not shown), which are known per se.

On the edge of the distribution disc 7, there is a second process wheel 8, which is rotatable in the direction D about a horizontal centre axis S2. Stick clamps 30 are arranged on the second process wheel, with which the lollipops are grasped by their sticks and lifted from the distribution disc 7.

Downstream of the second process wheel 8, a third process wheel 9 is arranged which rotates in the direction E about the centre axis S3. A series of lollipop holders is arranged on the third process wheel 9, at each of which a film/foil sheet clamp is positioned. A film/foil feed station 10 is positioned at the third process wheel 9, in which a roll of film/foil sheet material can be placed and unwound and can be cut into separate sheets F, delivered intermittently to the third process wheel 9.

Downstream of the third process wheel 9, viewed in the processing direction, a fourth process wheel 11 is disposed, which is rotatably driven in the direction F about the centre axis S4. The fourth process wheel 11 is provided with a series of co-rotating lollipop holders 50 and a series of co-rotating wrapping means, as well as heat-sealing means for heat-sealing the two twisted ends of the film/foil packaging sheet on the lollipop.

Lollipops packaged in the fourth process wheel 11 are passed on to a discharge wheel 12 which rotates in the direction G and can deliver the lollipops to a discharge 14 in order for them to be discharged in the direction J.

Figure 4:
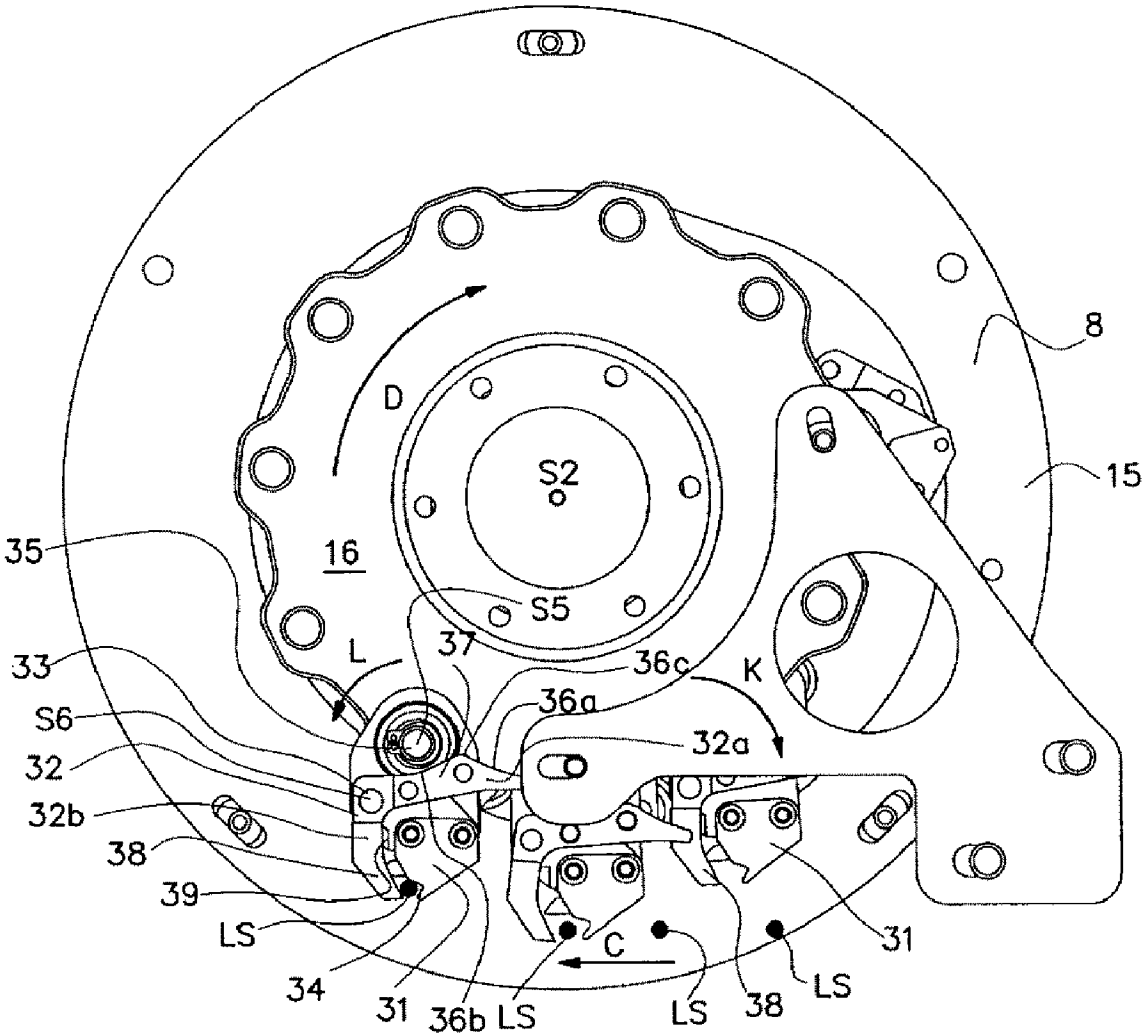
FIG. 4 shows a diagrammatic view of a second process wheel in the device from FIGS. 1-3.
Figure 4A:
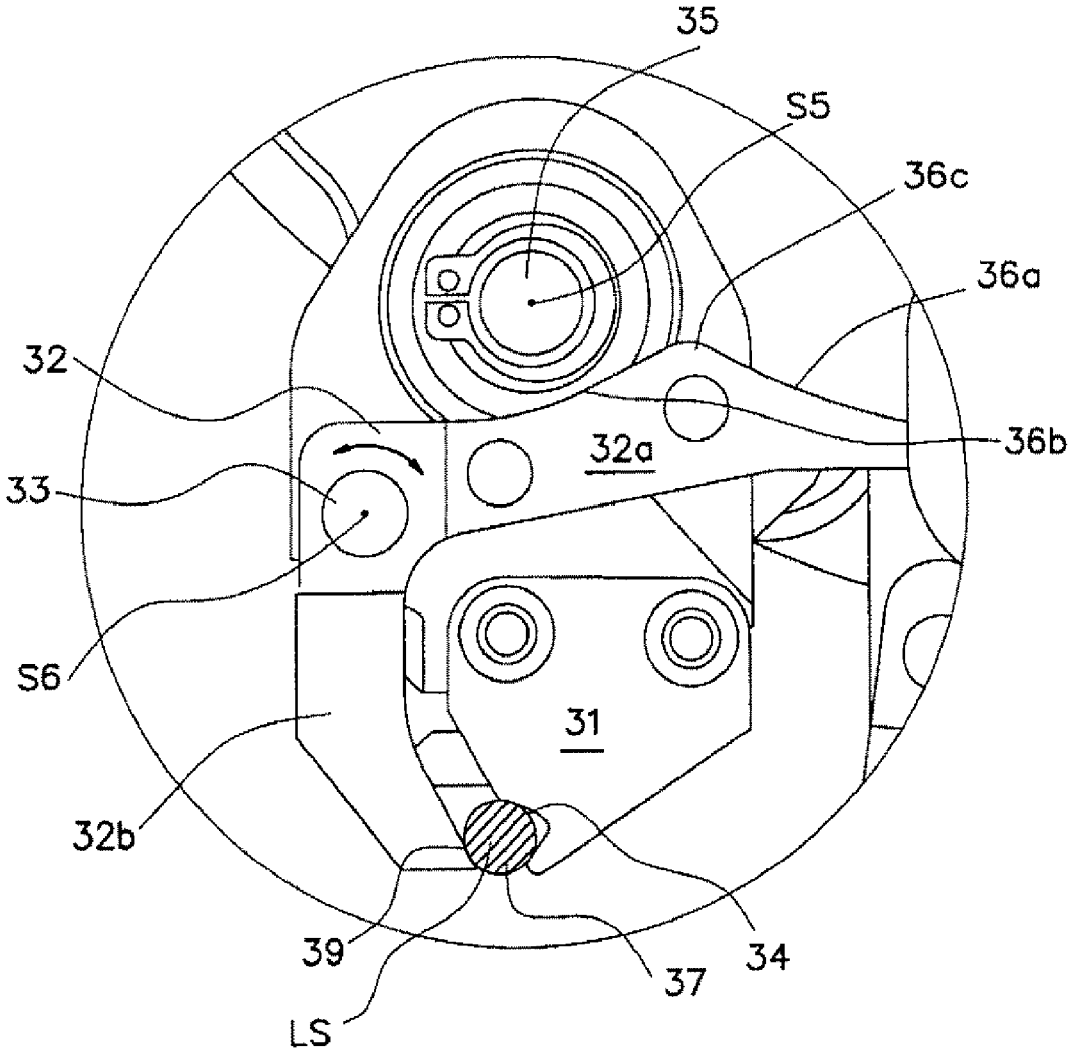
FIG. 4A shows a detail of a lollipop clamp in the wheel from FIG. 4.

The second process wheel 8 is illustrated in more detail in FIGS. 4, 4A,B and 5. The wheel 8 has a driven shaft 73, to which a disc 16 is fixedly attached. The second process wheel 8 furthermore comprises two stationary rings, i.e. (cf. FIG. 5) outer ring 15 and inner ring 17. The outer ring 15 is provided with an inwardly directed cam track 15*a* and the inner ring 17 is provided with an outwardly directed cam track 17*a*.

The U-shaped panels 38 are arranged on the rotating disc 16 at regular intervals, which panels 38 are pivotable relative to the wheel 16 in holes 16*a* about the horizontal centre axes S5, at the location of the pivots 35. The U-shaped panel 38 grips around the edge of the wheel 16 and comprises a front panel 38*a*, a rear panel 38*b* and a transverse body 83*c*. A panel 31 with a clamping jaw 34 is fixedly attached to the panel 38*a*. At the location of the pivot 33, an L-shaped lever 32 is attached to the clamping panel 38*a*, which lever 32 is pivotable about a horizontal centre axis S6. The lever 32 comprises an operating arm 32*a* with two concave operating surfaces 36*a,b* having a cam 36*c* between them. On the other side of the pivot 33, the lever arm 32*b* has a clamping jaw 39. The lever 32 is tensioned towards panel 31 by a spring with arm 32*b* (not shown).

It should be noted that such a wheel 8 with stick clamps 30 can also be used with a feeder rotating in a vertical plane, such as a conveyor belt, provided with controllable lollipop jaws, for supplying flat lollipops, for example.

Figure 4B:
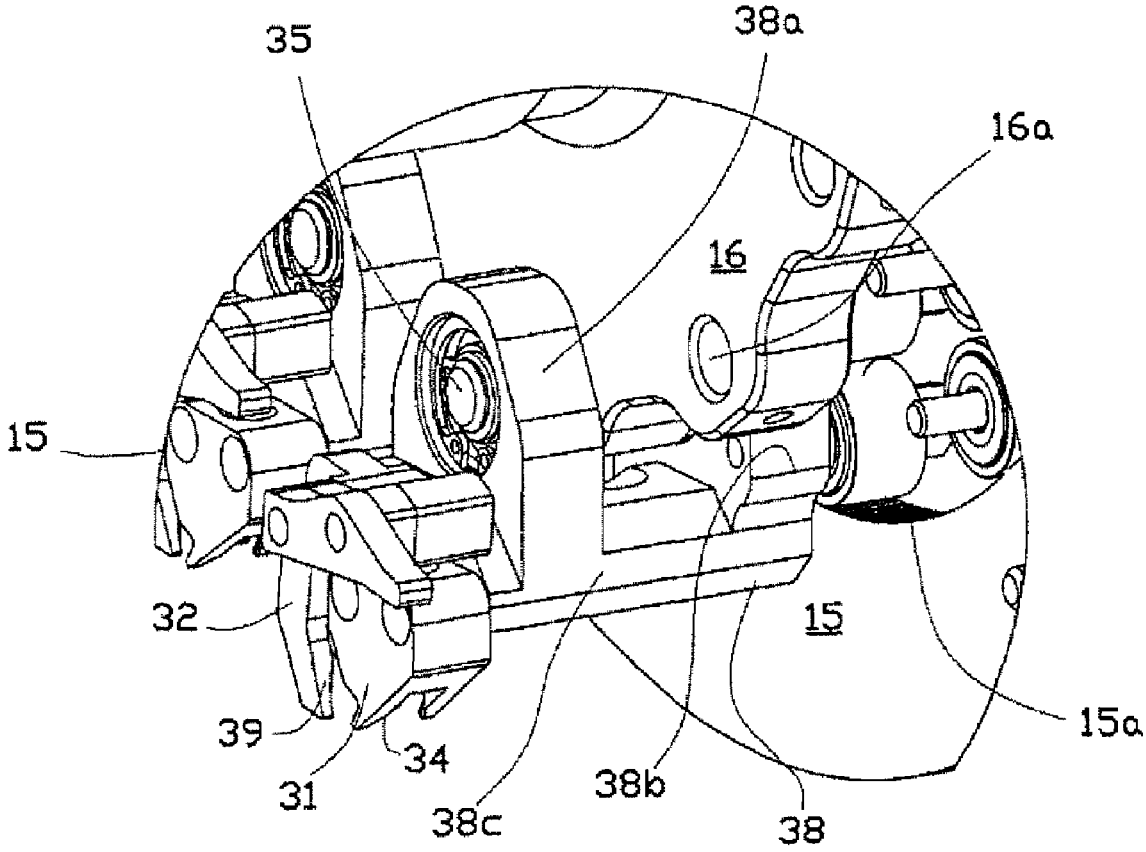
FIG. 4B shows an angled side view of the clamp from FIG. 4A.

As can be seen in FIG. 4B and FIG. 5, the stick clamp 30, in particular the U-panel 38, more particularly the rear panel 38*b*, is provided with two shafts 71*a*, 71*b*, to which two freely rotatable rollers 72*a*, 72*b* are attached, which are retained within the cam tracks 15*a*,17*a*. The surfaces of the rollers 72*a*,

72*b* are in each case in contact with the innermost cam track 17*a* and the outermost cam track 15*a*, respectively.

The third process wheel 9 illustrated in FIGS. 6-8B rotates in the direction E about the centre axis S3 and comprises a disc assembly 40 which co-rotates. On the edge of the disc assembly 40, a series of lollipop holders 41*a,b* is arranged, near each of which a film/foil sheet clamp 49 is positioned.

The lollipop holders 41 comprise two arms 41*a* and 41*b*, which (see FIG. 7B) are attached in mounting blocks 45*a,b* fixed to the disc assembly 40 so that they are pivotable about the pivots 48*a*, 48*b*, respectively. These pivots have centre axes which run tangentially to the orbit path in the direction E.

Again referring to FIG. 7B, one lollipop holder 41*a* is converted in the lateral direction next to pivot 48*a* into lever arm 47, at the bottom end of which a roller 47*a* is arranged which can rotate freely about its own shaft and has a convex surface. The convex surface of the roller 47*a* on both sides contacts fixedly arranged cam tracks 42*a,b*.

At the pivots 48*a,b* the lollipop holder arms 41*a,b* are provided with intermeshing circular toothings 46*a,b*. When the roller 47*a* is displaced in the direction T, the lollipop holder arm 41*a* will thus turn in the direction P, the lollipop holder arm 49*b* undergoing an opposite displacement as a result of the intermeshing toothing 46*a,b*. The same applies to the ends 82*a,b* of the lollipop holder arms 41*a,b*.

The ends 81*a,b* are replaceably arranged on the arms 41*a,b* of the lollipop holders 41. The ends 81*a,b* are provided with respective holder heads 82*a,b*, the head 82*a* being provided with a holding space 83*a* which corresponds to the shape of the lollipop head to be processed. The head 82*b* is provided with a holding space 83*b* for the opposite (stick) end of the lollipop head and for the stick of the lollipop, and widens radially outwardly in opening 84 (see also FIG. 6 where a head 81*b* has been omitted for illustrative purposes), so that the lollipop with stick can be displaced slightly transversely to the centre axis S3 relative to the head 81*b*, even after a slight turn of the head 81*b* in the direction U.

Figure 6:
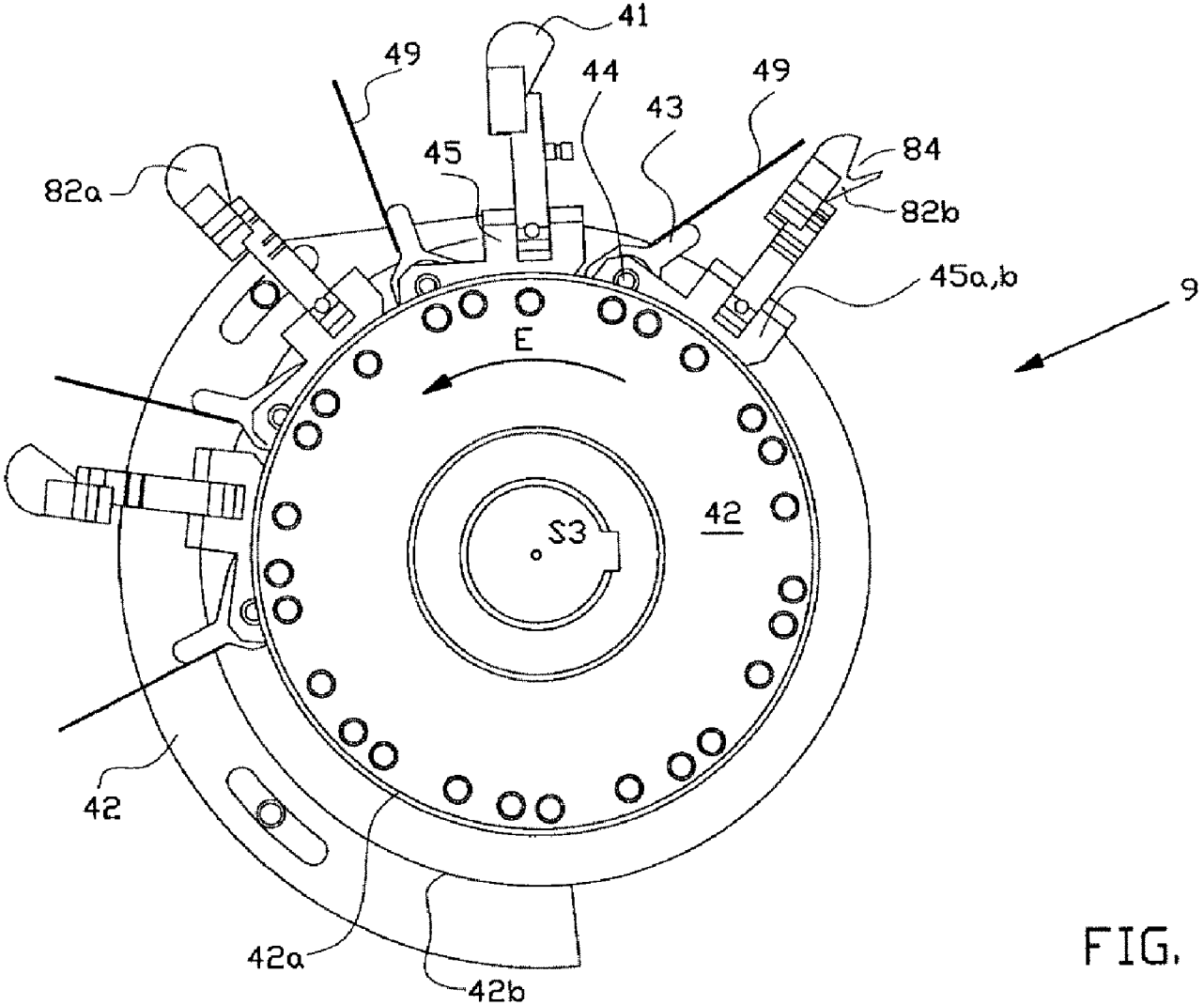
FIG. 6 shows a front view of the third process wheel in the device from FIG. 1 et seq.
Figure 7A:
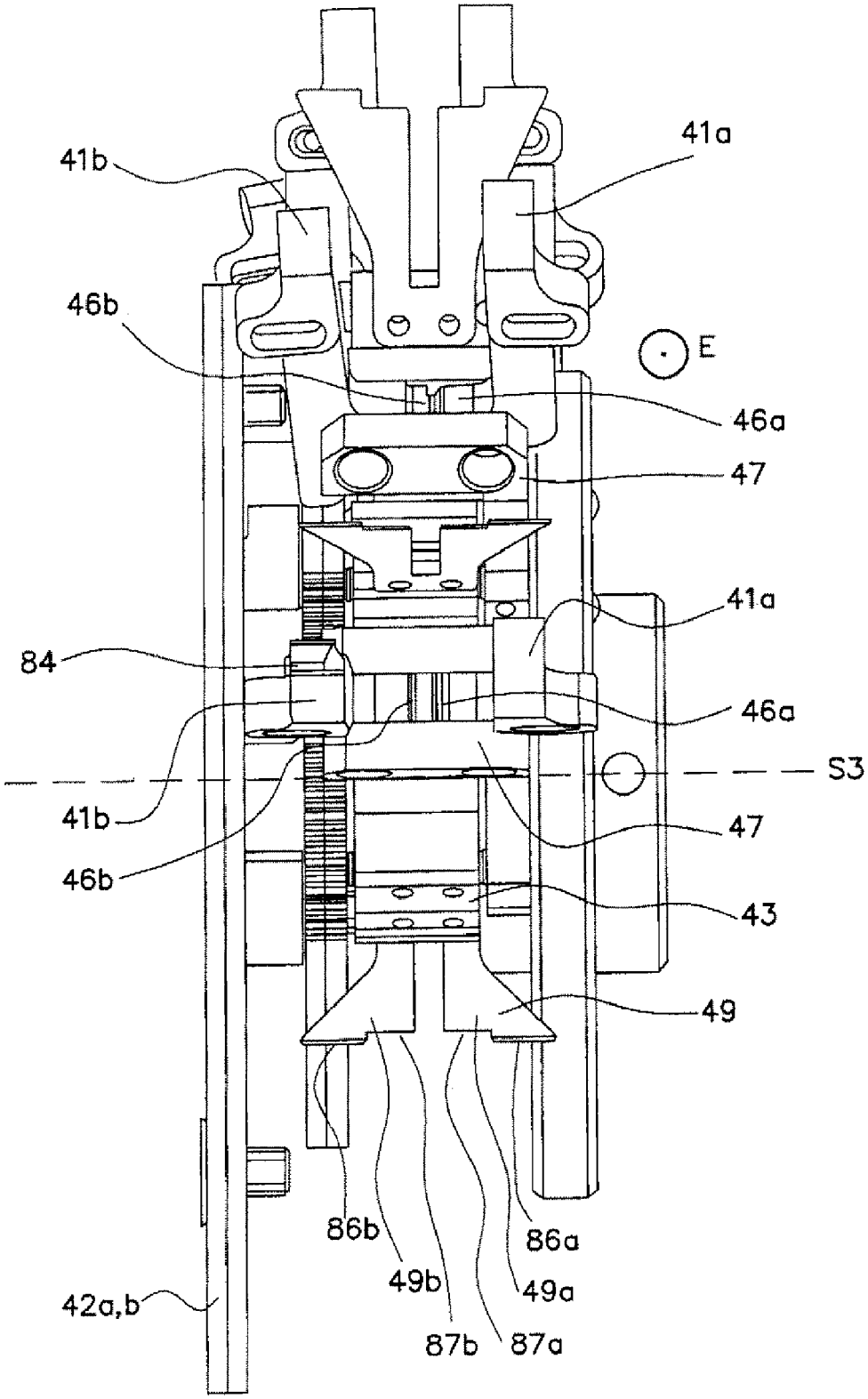
FIG. 7A shows a side view of the third process wheel from FIG. 6.
Figure 7B:
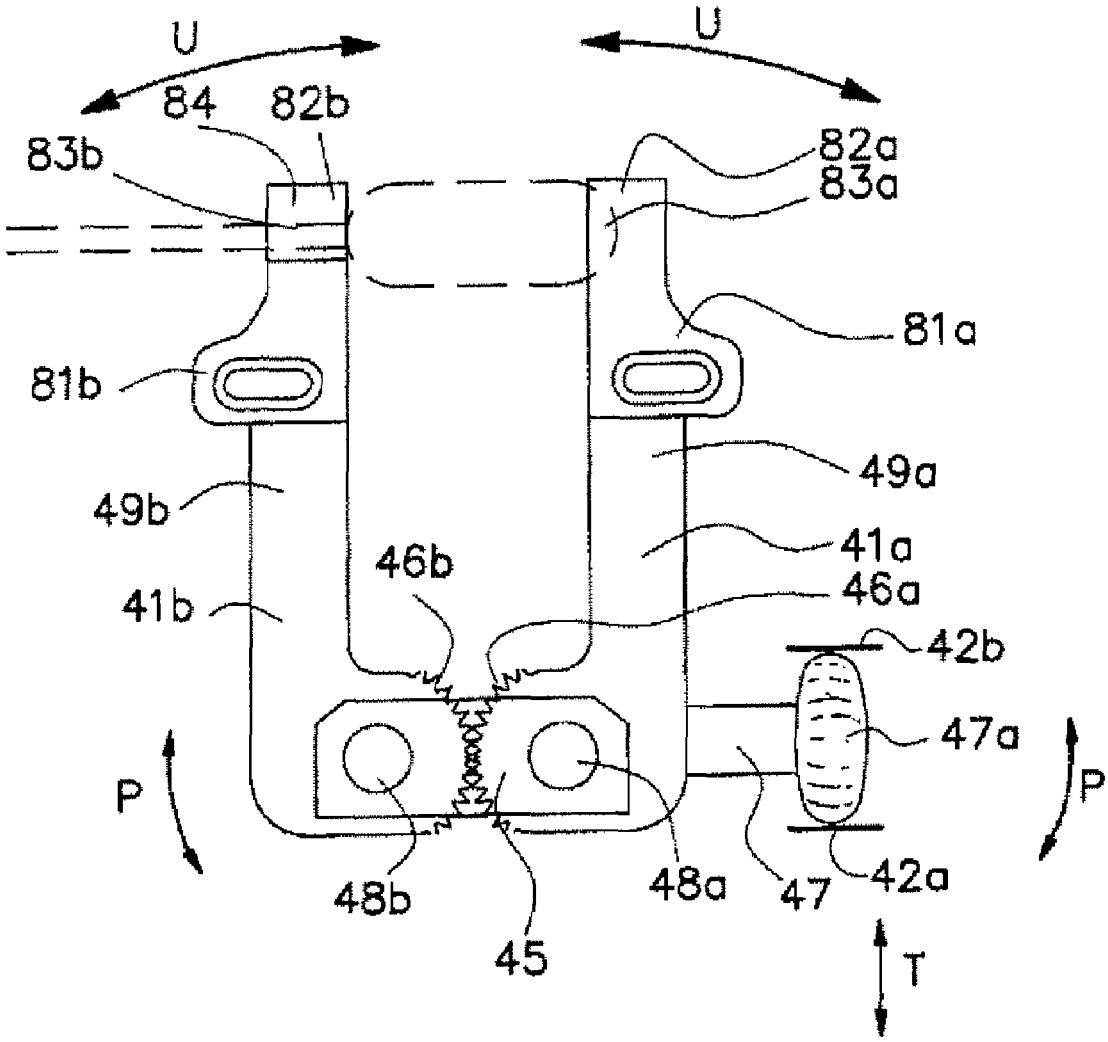
FIG. 7B shows a detail of a lollipop holder in the third process wheel.

As can be seen in FIG. 6, the leading side of the head 81*a* is provided with a partially convex surface 85*a,b*. The selected heads 81*a,b* have a diameter and shape, such that, as is illustrated diagrammatically in FIG. 7B, the head of the lollipop to be treated engages in its contours.

On the side of the lollipop holders 41*a,b* facing the conveying direction E, a resiliently bendable, panel-shaped film/foil holder panel 49 is arranged, which panel is attached to a mounting part 43, which is pivotably attached at 44 to the disc assembly 40 in order to be able to rotate (direction N), in a controlled manner, about a centre axis parallel to the centre axis S3.

As can be seen in FIG. 8, the panel 49 in fact consists of two panels 49*a,b*, which define a gap between them. They flare out in order to each define a grip edge 86*a,b* for the film/foil sheet. Recesses 87*a,b* are provided in order to stay beyond the reach of a lollipop head. The position of the edges 86*a,b* is such that they can press onto the outer surfaces 85*a,b* of the heads 81*a,b* of the lollipop holders 41*a,b*.

Figure 8A:
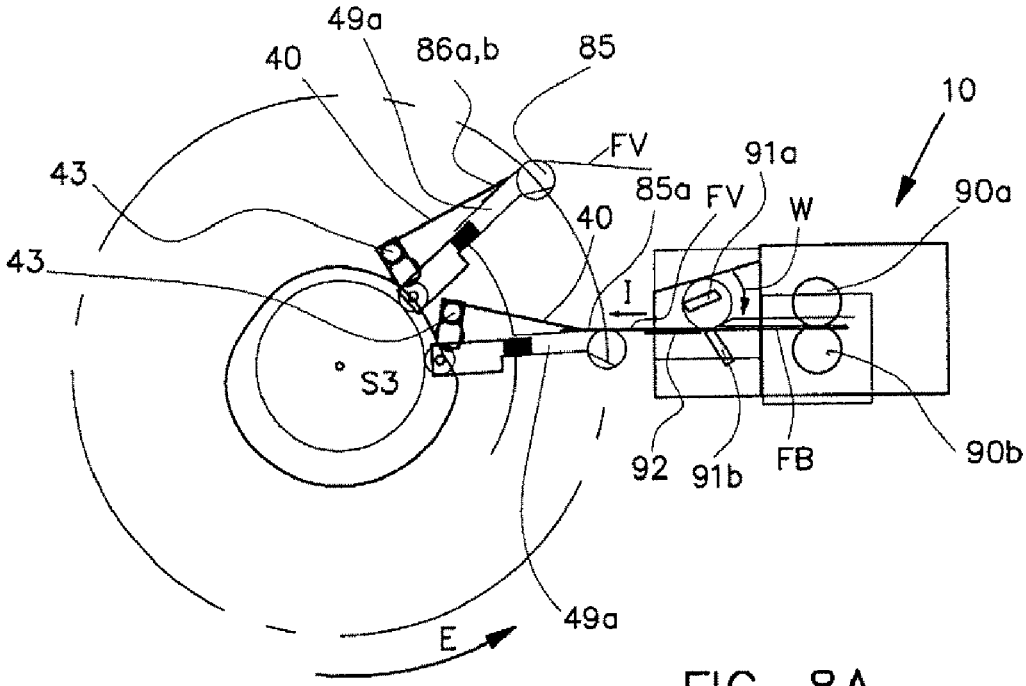
FIGS. 8A and 8B show diagrammatic representations of a film/foil sheet being received in the third process wheel from FIGS. 6 and 7.
Figure 8B:
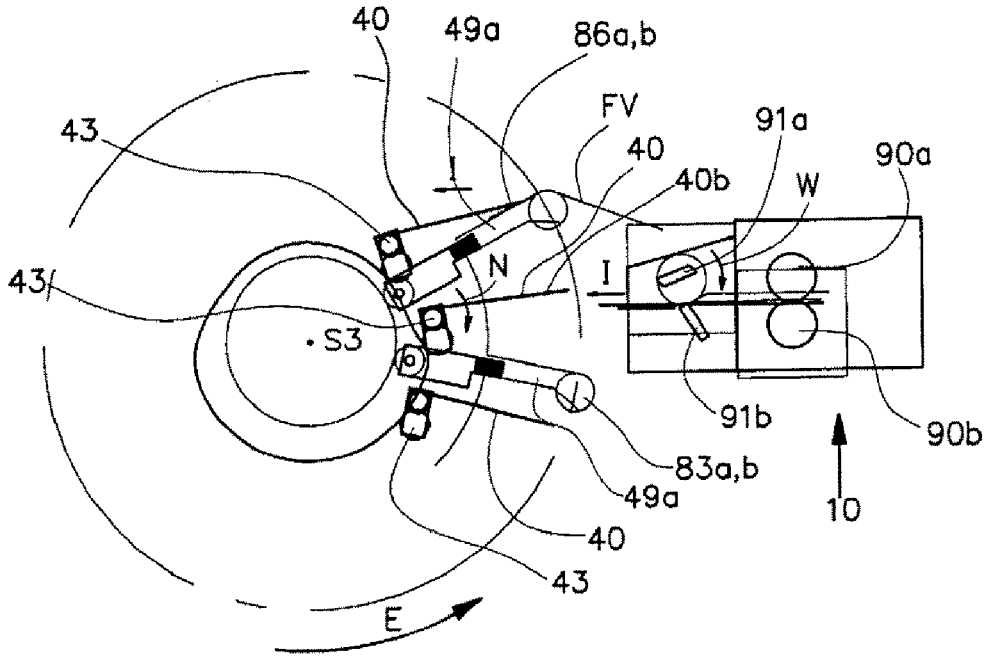
Figure 9:
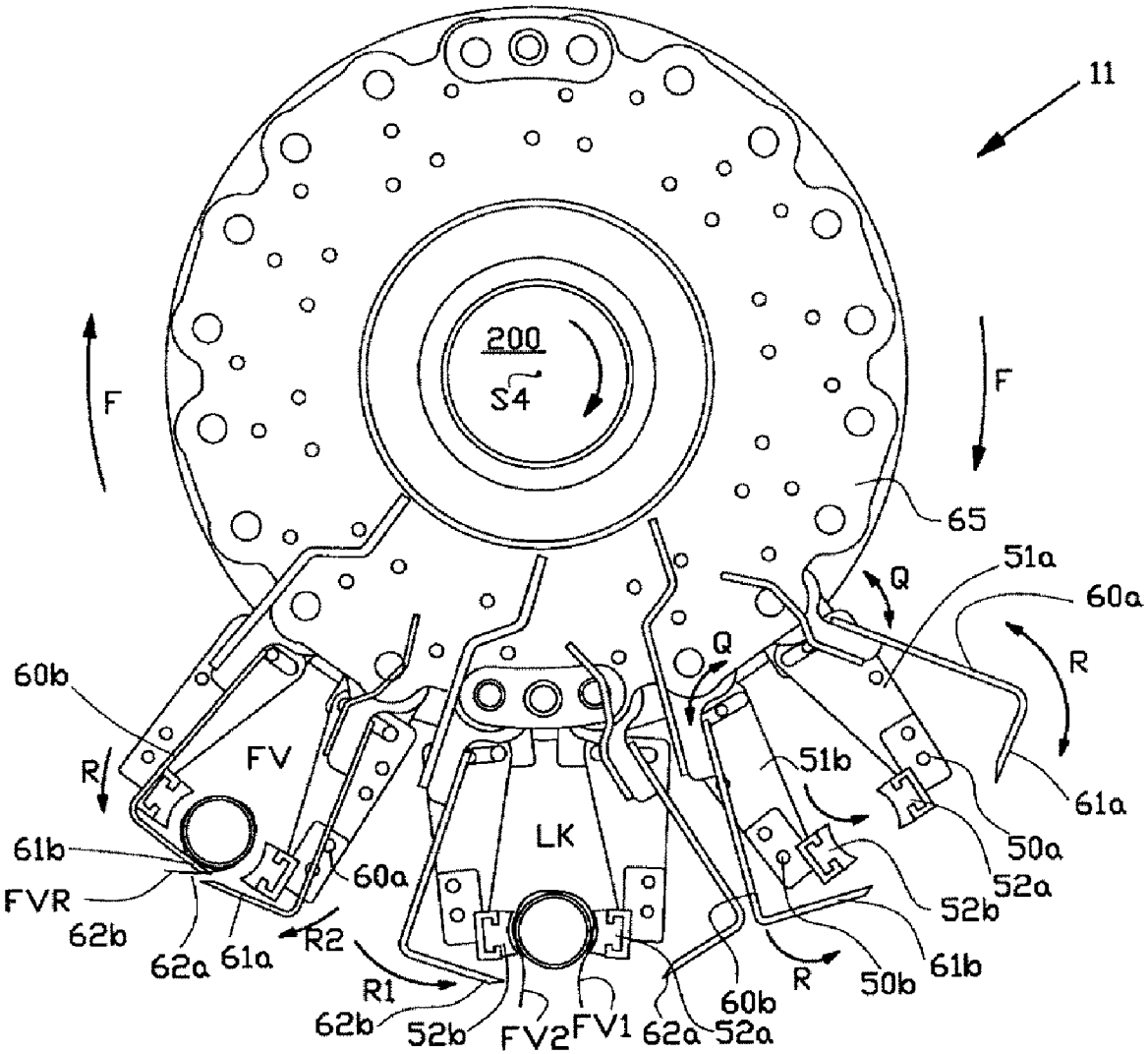
FIG. 9 shows a diagrammatic front view of a part of the fourth process wheel in the device from FIG. 1 et seq.

In FIGS. 8A,B, the film/foil feed station 10 is illustrated, which is provided with feed rollers 90*a,b* for a film/foil web Fb, and downstream thereof with a knife set 91*a,b*, the knife 91*a* being rotatable in the direction W and the knife 91*b* being stationary. Film/foil sheets Fv are cut with the aid of the knife pair 91*a,b* and delivered to process wheel 9 in the direction I, supported by panel 92.

FIGS. 9-12B show the fourth process wheel 11, which wheel comprises a shaft 200 which is rotatably driven in the direction F about centre axis S4. A disc assembly is mounted on the shaft, on the circumference of which a series of lollipop holders 50 and a series of folders 60 are arranged. Each lollipop holder 50 has a folder 60 associated with it.

Each of the lollipop holders 50 consists of two arms 51*a,b*, which are pivotable in the directions Q, in a controlled manner (not illustrated in any more detail), such as for example by means of a cam track, about centre axes parallel to the centre axis S4. The arms 51*a,b* are provided on their ends with rubber inserts 52*a,b* for engagement with a lollipop head.

Each of the folders 60 comprises two folding arms 60*a,b* with flanged legs 61*a,b*, which are provided at the ends with bevels 62*a,b*, the bevel of leg 61*a* fitting over/onto the bevel 62*b*.

Figure 10:
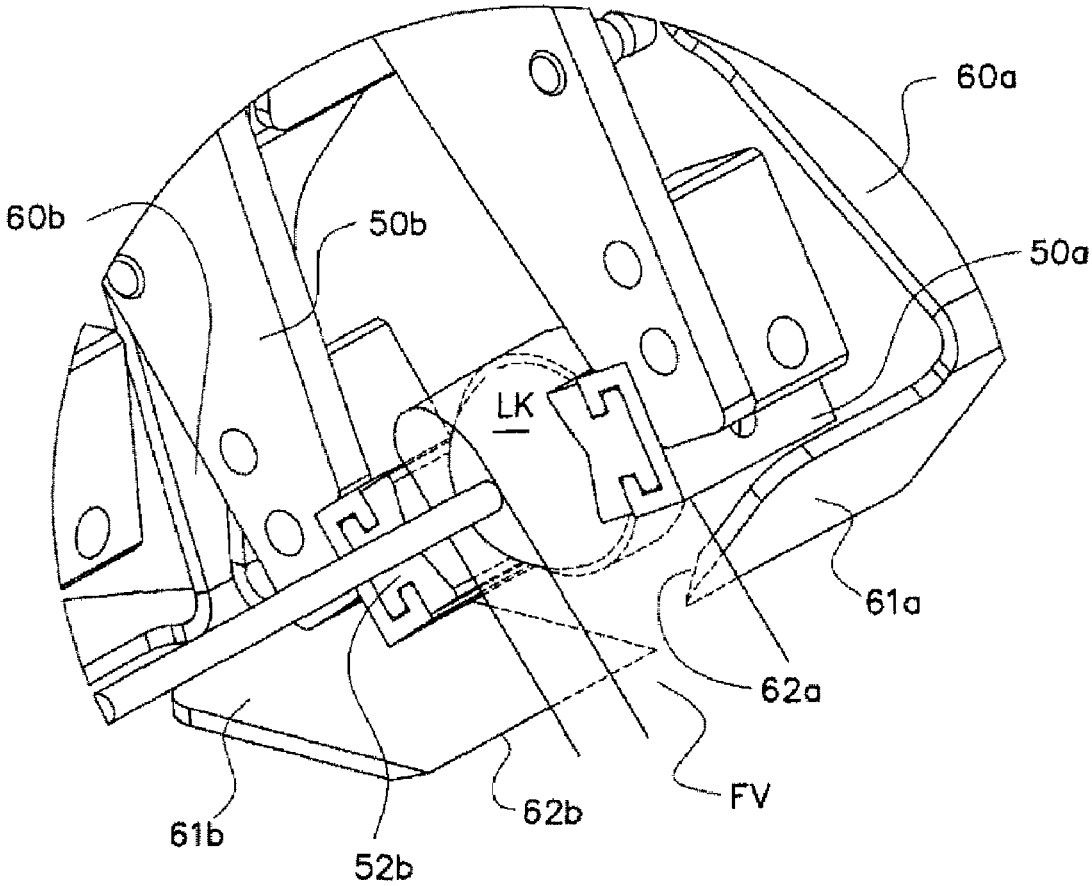
FIG. 10 shows an angled side view of a folding/clamping unit on the fourth process wheel from FIG. 9.
Figure 11:
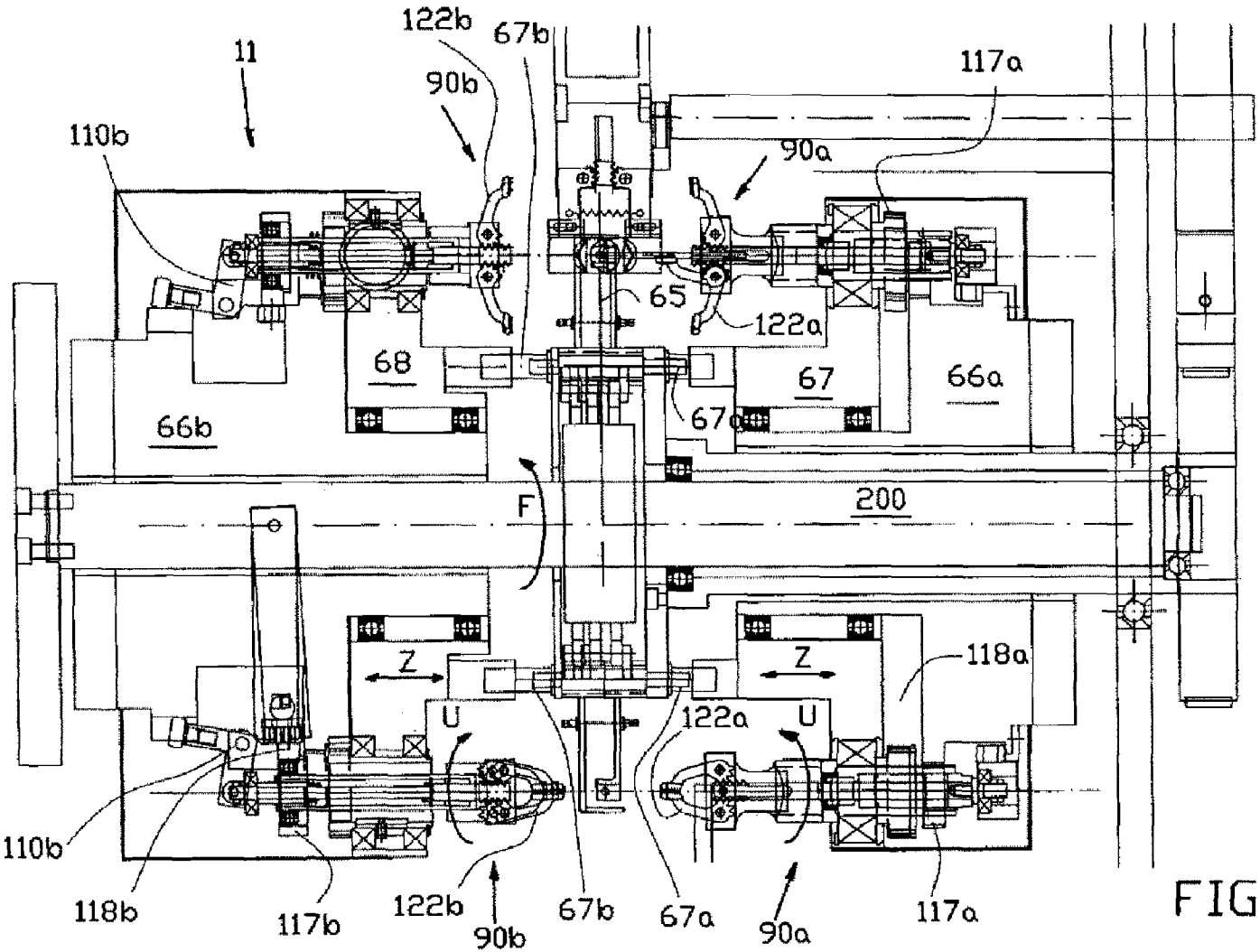
FIG. 11 shows a view of the entire fourth process wheel in the device from FIG. 1.

As can be seen in FIG. 10, the width, the dimension parallel to the centre axis S4, of the folders 60*a,b* is just slightly larger than the length of the head of the lollipop. The lollipop holders, in particular the rubbers 52*a,b* and the holding spaces therefor, are shorter.

Two discs 68, 69 are mounted on the shaft 200 on either side of the disc assembly 65. These discs are provided with series of twisters 90*a,b*, such as are illustrated, for example, in FIGS. 11 and 12A,B. When the disc assembly 65 is rotated, the discs 68, 69 co-rotate as these discs form one rotating unit together with the disc assembly 65 as a result of coaxial connecting pins 67*a,b*.

Series of twisters 90*a,b* are arranged on the discs 68, 69 in order to cooperate with each lollipop holder 50 and folder 60. Each twister 90*a,b* comprises an operating pin 113*a,b* which can be moved in the directions Z, parallel to the centre axis S4. At the end of the pin 113*a,b*, an L-shaped lever 110*a,b* is attached, which is pivotable about the pivots 111*a,b* fixed to the discs 68, 69, the centre axis of the pivots extending tangentially to the orbit path. The ends of the L-shaped arms 110*a,b* are provided with a roll 112*a,b* which contacts a cam track of fixed discs 66*a,b*. By a suitable design of the cam track, the L-shaped arms 110*a,b* can turn in the direction L, thus moving the pins 113*a,b* in the direction Z.

Twist holders 116*a,b* are rotatably mounted in the rotating discs 68, 69 by means of rotary bearings 120*a,b*. On the ends facing each other, each of the twist holders 116*a,b* is provided with a number of twist arms 122*a,b*, which are pivotably attached to the twist holders 116*a,b* on the one end 121*a,b* and are provided with grippers for the film/foil sheet in which the lollipop is packaged at the other end 122*a,b*. On their end situated near the pivots 121*a,b*, each of the twist arms 122*a,b* is provided with a circular toothing 115*a,b*. These toothings are in engagement with toothed racks 124*a,b* on the end of the pins 113*a,b*. By displacing the pins 113*a,b* in the direction Z, the twist arms 122*a,b* will rotate in the direction V, towards each other or away from one another. It should be pointed out that the end of the toothed rack of the pin 113*a* has a holding space 125 for a lollipop stick.

Figure 12A:
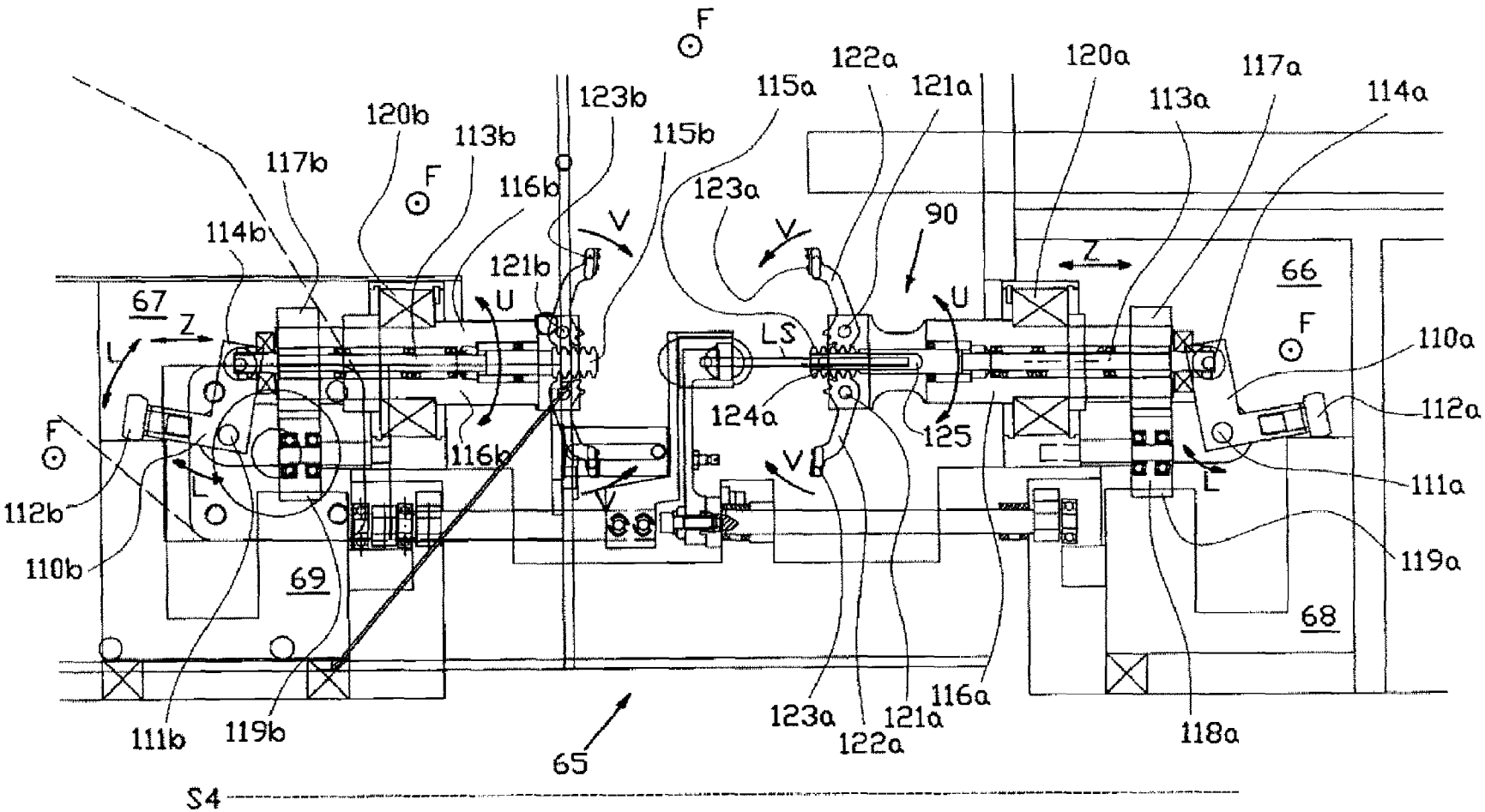
FIGS. 12A and 12B show successive states when wrapping a film/foil sheet around a lollipop in the fourth process wheel.
Figure 12B:
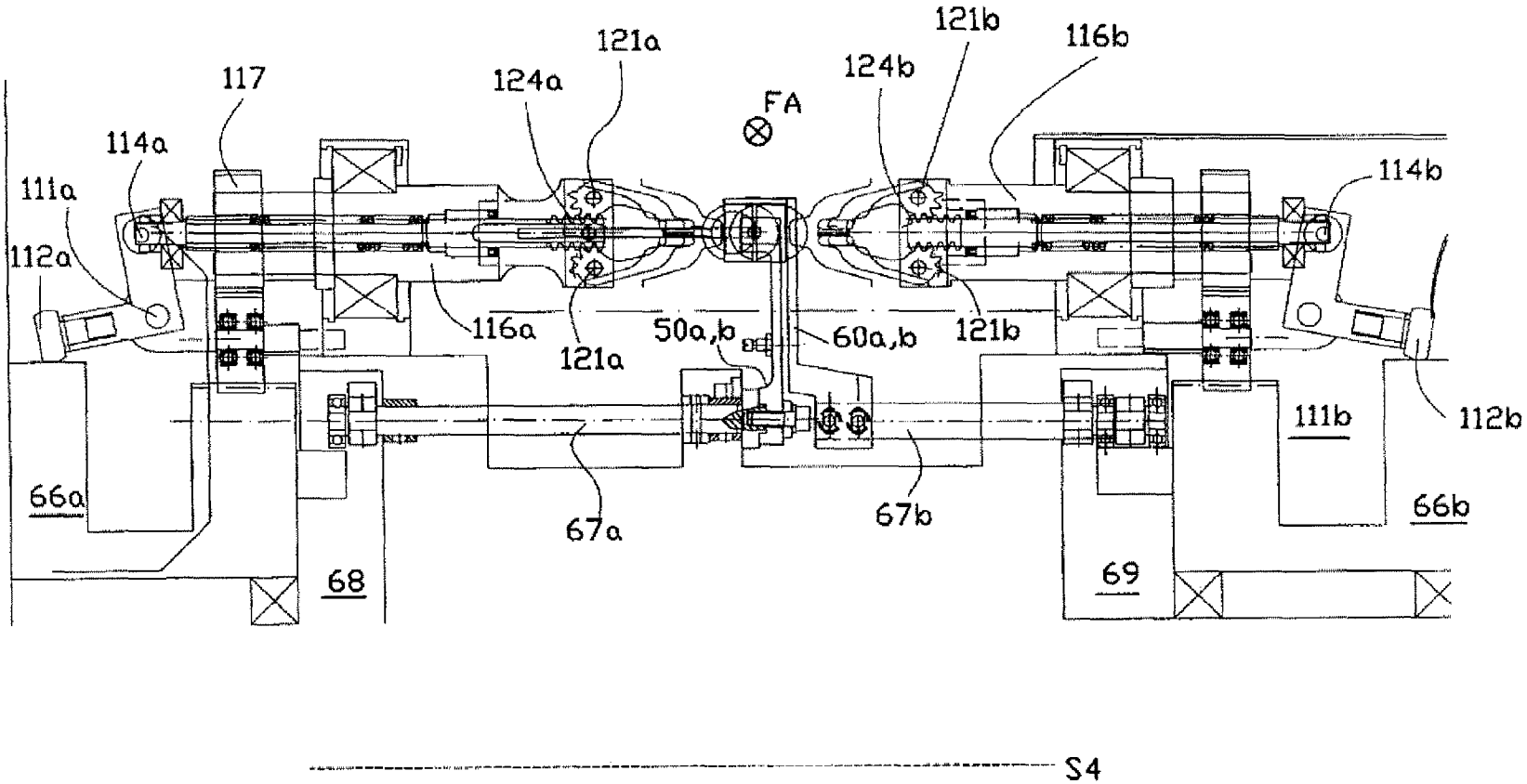

The position of the twist arms 122*a,b* with respect to one another (in the direction parallel to the centre axis S4) is such that, after rotation in the direction V from the open position, shown in FIG. 12A, to the closed position, shown in FIG. 12B, the film/foil clamps 123*a,b* end up on either side of the head of the lollipop to be treated. The film/foil clamps 123*a,b* are in this case placed on the arms 122*a,b* in such a manner that the twist arms 122*a,b* do not interfere with the stick.

In use, the device 1 shown in FIG. 1 supplies the lollipops in the direction A to the storage container 3, from where they fall in the direction B onto the distribution disc 7. The distribution disc 7 is rotated in the direction C. During this rotation, which takes place in a manner known per se and with the aid of means known per se, which will not be discussed in more detail, the lollipops are spread, in such a manner that they are spread over the distribution surface 20 towards the edges and their heads are received in the holding spaces 22, the sticks extending in the slots 21 in a horizontal, radially outward direction.

Thus a series of correctly positioned lollipops arrives at the second process wheel 8, which is rotated in the direction D. As a result of the shape of the cam edges 15*a*, 17*a* (FIG. 5), and their interaction with the rollers 72*a,b*, the lollipop clamps 30 are accelerated or rotated in the direction K about their pivot centre axis S5 before arriving at the transfer station, until they, as indicated in FIG. 4, with the clamping jaws 34, 39 form a vertically downwardly opening access 37 for a lollipop stick Ls for a lollipop which is still on the distribution disc 7. The connection line running through the line S5 and through the access opening 37 is in this case at least substantially vertical.

This individual orientation of the stick clamp 30 is maintained during continued rotation until the receiving position illustrated in the centre of FIG. 4 is reached. In this case, the stick clamp 30 is turned back in the direction L relative to the radial of the wheel 15 by suitable cooperation between the cam edges or tracks 15*a*, 17*a* and the rollers 72*a,b*. In the run-up to the lollipop sticks Ls being received, a fixedly arranged cam roller which contacts the concave surface 36*a* of the lever arm 32*a* ensures that the clamping arm 32*b* rotatable about the pivot S6 is turned away in order to create the opening 37 between the clamping jaws or surfaces 34, 39 which is at its greatest at the location of the cam 36*c*.

As soon as the stick Ls is situated in the space between the clamping jaws 34, 39, the concave surface 36*b* runs past the abovementioned cam roller and moves the L-shaped arm 32 back, on account of a spring force (not shown), as a result of which the stick Ls is firmly clamped between the clamping surfaces 34, 39. In order to assist this process, the cam edges 15*a*, 17*a* are shaped in such a manner that the stick clamp 30 is rotated back further, relative to the radial at the wheel 15, in the direction L. Thus, the third position, indicated on the left in FIG. 4 is reached. The lollipop is then removed from the distribution disc 7 and entrained in the direction D by the respective stick clamp 30. By suitable design of the cam edges 15*a*, 17*a*, the respective stick clamp 30 can be rotated, relative to the respective radial of the wheel 15, to an orientation which is suitable for transfer to the third process wheel 9.

Because the stick clamps 30 fix the lollipops onto the sticks, not only can the lollipops be picked up radially outside the distribution disc 7, but the head is also free for subsequent receiving/taking over by the third process wheel 9. When the lollipops held by the stick clamps 30 have reached the path of the lollipop holders 41*a,b* of the third process wheel 9, at the location of the transfer of the lollipops from the second transfer wheel to the third process wheel 9, the lollipop holders 41*a,b* are brought closer together in the direction U, by rotation of the intermeshing toothings 46*a,b* in the direction P, which rotation is caused by the displacement of the abovementioned roller 47*a* in the direction T. The lollipop holder 41*a* with the holding space 83*a* moves onto the free end of the lollipop head. At the same time, the lollipop holder 41*b* with the head 81*b* moves, with the slot 84, over the lollipop stick until it engages with the other end of the lollipop head. The lollipop head Lk is now clamped between the lollipop holders 41*a,b*, the contour of the lollipop not protruding beyond the contour of the heads 81*a,b* of the lollipop holders 41*a,b*.

The third process disc 9 rotates in the direction E towards the film/foil feed station 10. There, cut film/foil sheets Fv are delivered in the direction I, in the horizontal direction, up to an end in the path of the leading side of the lollipop holders 41*a,b*.

Directly thereafter, the support part 43 is rotated in the direction N, so that the film/foil sheet clamp 40 is rotated in the direction N in order to press on the film/foil sheet Fv with the clamping edges 86*a,b* against the surfaces 85*a,b*. The film/foil sheet Fv is then firmly clamped onto the lollipop holder heads 81*a,b*, which firmly clamp the lollipop between them. By rotating the wheel set 42, the combination of lollipop and film/foil sheet Fv is taken to the transition with the fourth process wheel 11.

At the transition to the fourth process wheel 11, the roller 47*a* is forced in the opposite direction T, as a result of which the lollipop holders 41*a,b* move apart, so that the lollipop, which has only just been clamped between the rubbers 52*a,b*, and the film/foil can readily be entrained by the fourth process wheel 11.

In the fourth process wheel 11, the holder arms 51*a,b* are moved into an open position. This is illustrated on the right-hand side in FIG. 9. When the lollipop head is received between the rubbers 42*a,b*, the film/foil sheet Fv folded around it is also gripped, in which case two legs Fv1 and Fv2 are suspended from the film/foil sheet.

As the rotation continues further in the direction F, the leading folding leg 61*b* is then first folded against the leg Fv1, and then the trailing folding leg 61*a* is turned backwards (R), in which case the film/foil sheet leg Fv2 is forced backwards and is folded over the two sides of the folding leg 61*b* with a free edge of the film/foil sheet leg Fv1. The cooperating bevelled edges 62*a,b* assist this process and align the overlap.

The film/foil sheet Fv is now folded correctly around the lollipop head Lk. The trailing folding leg 61*a* can now be retracted. The overlap of the film/foil sheet legs Fv1 and Fv2 is in this case held in place by the leading folding leg 61*b*.

Next, as the rotation continues in the direction F, the co-rotating and continuously rotating twisters 90*a,b* are activated. The rollers 112*a,b* running over the fixed cam tracks of the fixed discs 66*a,b* are moved radially inwards against the spring action (springs which are situated around the pins 113*a,b* and in the holder 116*a,b*), as a result of which the pins 113*a,b* move apart in the direction Z. As a result of the toothed rack/toothing engagement, the twister arms 122*a,b* are moved together in the direction V, and with the clamp 123*a,b* grip the film/foil sheet sections protruding from the lollipop head in both axial directions, which film/foil sheet sections have a kind of tubular shape there. The film/foil tube ends are then clamped such that they are flat. As a consequence of the continuous engagement of the toothings 118*a,b* and the fixed sets of teeth 119*a,b*, the toothed wheels 118*a,b* rotate and thus the toothed wheels 117*a,b* and therefore the twister holders 116*a,b*. The lollipop head in this case remains held by the lollipop holder rubbers 52*a,b* and thus also the stick, so that the flattened film/foil tube sections are turned by the rotating twister arms 122*a,b* and the twister clamps 123*a,b* forming a single entity with the latter. Hot air may be supplied by means (not shown) at the location of the film/foil tube section twisted or being twisted in this manner.

Finally, the lollipop is covered by a double-twisted film/foil sheet.

The wheel assembly 65 and thus also the discs 68, 69 have arrived, together with the relevant packaged lollipop, at the delivery station in the form of a take-over disc 12, where the lollipop can be taken over by its stick and turned in the direction G in order to fall in the container 14, and there slide off in the direction J, towards the back of the machine 1. Upon delivery, the rollers 112*a,b* are again forced back to the position illustrated in FIG. 12A on account of the spring action and the twister arms 122*a,b* have been forced into the open position. The folding arm 61*b* has been moved into the open starting position again, if desired at the initial twisting stage. When the lollipop is delivered to the take-over disc 12, the lollipop holders 51*a,b* are moved apart in order to release the lollipop.

With the discharge J being situated at the rear and the supply A also being located at the rear, the space in front of and to the side of the machine 1 is left clear for operating staff.

The invention claimed is:

1. A packaging machine for packaging lollipops provided with a stick and a head in a film/foil sheet, comprising a rotatably driven drum having a series of lollipop holders thereon that clamp the lollipop head, the drum furthermore being provided with a series of film/foil folding means for folding a respective film/foil sheet around the head around a longitudinal centre axis substantially parallel to the stick, the packaging machine for packaging lollipops furthermore comprising a series of twisters for twisting a film/foil tube section protruding in the longitudinal direction of the lollipop head while continuing to clamp the lollipop head and while the drum continues to rotate, wherein the twisters comprise first and second twisting means which twist the film/foil tube sections protruding on either side of the head, viewed in the longitudinal direction, wherein the lollipop holders are arranged on a first disc and the twisters are arranged on at least one second disc, the first and second discs being connected to one another for concomitant rotation.

2. The packaging machine according to claim 1, wherein the first disc is driven directly and the second disc is entrained by the first disc in the rotating movement.

3. The packaging machine according to claim 2, wherein the first twisters are arranged on the second disc and the second twisters are arranged on a further second disc, both second discs being situated on either side of the first disc.

4. The packaging machine according to claim 1, further comprising folding parts comprising a first folding arm and a second folding arm, which are provided with folding ends which are oppositely tapered in order to overlap at least a portion of the folding ends.

5. The packaging machine according to claim 4, wherein the folding parts are provided with operating means for the folding arms, which are designed to first activate the second folding arm and then the first folding arm.

6. The packaging machine according to claim 5, wherein the operating means of the folding arms are designed to deactivate the second folding arm once the first folding arm has been activated.

* * * * *